US009656137B2

(12) United States Patent
Downing et al.

(10) Patent No.: US 9,656,137 B2
(45) **Date of Patent: *May 23, 2017**

(54) TWO-PART HOCKEY STICK

(71) Applicant: SPORT MASKA INC., Montreal (CA)

(72) Inventors: Travis Downing, Carlsbad, CA (US); Eric Allard, St-Hubert (CA); Matthieu Sola, Montreal (CA); Etienne Champagne, Montreal (CA); Colin Zou, Shenzen (CN)

(73) Assignee: SPORT MASKA INC., Montréal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/074,664

(22) Filed: Mar. 18, 2016

(65) Prior Publication Data

US 2016/0199712 A1 Jul. 14, 2016

Related U.S. Application Data

(63) Continuation of application No. 14/455,415, filed on Aug. 8, 2014, now Pat. No. 9,320,952.

(51) Int. Cl.

| | |
|---|---|
| ***A63B 59/70*** | (2015.01) |
| ***A63B 59/14*** | (2006.01) |
| *A63B 102/24* | (2015.01) |

(52) U.S. Cl.

CPC ..... *A63B 59/70* (2015.10); *A63B 59/14* (2013.01); *A63B 2102/24* (2015.10); *A63B 2209/02* (2013.01)

(58) Field of Classification Search

CPC ..... A63B 59/12; A63B 59/14

USPC ..... 473/562, 563, 560, 561; 273/108.1

See application file for complete search history.

(56) References Cited

U.S. PATENT DOCUMENTS

| | | | |
|---|---|---|---|
| 6,626,775 | B2 | 9/2003 | Tiitola |
| 7,326,135 | B2 | 2/2008 | Lussier et al. |
| 7,438,655 | B2 | 10/2008 | Garcia |
| 7,520,829 | B2 | 4/2009 | Mollner et al. |
| 8,608,597 | B2 | 12/2013 | Avnery et al. |
| 2002/0061374 | A1 | 5/2002 | O'Brien et al. |
| 2004/0229720 | A1 | 11/2004 | Halko et al. |
| 2013/0005518 | A1 | 1/2013 | Baroux |
| 2013/0172135 | A1 | 7/2013 | Jeanneau |

FOREIGN PATENT DOCUMENTS

| | | |
|---|---|---|
| CA | 2135084 | 5/1996 |
| CA | 2502630 | 9/2005 |
| CA | 2762872 | 6/2013 |

*Primary Examiner* — Aarti B Berdichevsky
*Assistant Examiner* — Rayshun Peng
(74) *Attorney, Agent, or Firm* — Norton Rose Fulbright Canada LLP

(57) ABSTRACT

A two-part hockey stick having a hockey stick blade and a hockey stick shaft joined together at a joint. The hockey stick has a blade with a neck, a heel, and a toe. The joint has a male joint portion on an end of the shaft, which has heel and opposed toe walls, each of which extend away from a distal surface of the shaft and terminate at a mating surface. The heel wall is disposed on a side of the joint adjacent to a heel of the blade, and is longer than the toe wall. The mating surface extends between the heel and toe walls. The joint also has a hollow female joint portion disposed in a neck of the blade. The male joint portion mates with the female joint portion, thereby joining the shaft to the blade and forming the hockey stick.

20 Claims, 4 Drawing Sheets

TWO-PART HOCKEY STICK

TECHNICAL FIELD

The present relates generally to hockey sticks and, more particularly, to a two-part hockey stick formed of a blade and a shaft.

BACKGROUND OF THE ART

Conventional hockey sticks, such as those used for playing ice or street hockey, have a shaft and an adjoining blade.

It is sometimes desirable to make the stick from a separate shaft and blade, and to join these components together. Typically, the blade will have a rectangular cuboid end which is joined with a correspondingly shaped end of the shaft. It is known that such joints can lead to a loss in the overall strength of the stick. It is also known that such a joint may suffer undesirable stress and strain at the joint interface.

SUMMARY

In one aspect, there is provided a hockey stick, comprising: a blade extending between a neck and a toe, and defining a heel, the neck having a neck rim circumscribing a neck opening which defines a female joint portion disposed within the neck; and a shaft having a body extending between a grip end and an opposed blade end terminating at a distal surface, a male joint portion disposed at the blade end and mating with the female joint portion of the blade, the male joint portion having a heel wall on a first side of the male joint portion adjacent to the heel of the blade and a toe wall on a second side of the male joint portion opposite the heel wall, the heel wall extending away from the distal surface a first length and the toe wall extending away from the distal surface a second length, the first length being greater than the second length, the heel and toe walls terminating at a common curved mating surface extending between the heel and toe walls.

In another aspect, there is provided a hockey stick shaft, comprising a body extending between a grip end and an opposed blade end terminating at a distal surface, and a male joint portion protruding from the distal surface and adapted to mate with a corresponding female joint portion of a hockey stick blade, the male joint portion having a heel wall extending from the distal surface a first length and an opposed toe wall extending from the distal surface a second length, the first length being greater than the second length such that the heel wall of the male joint portion extends further than the opposed toe wall, the heel and toe walls terminating at a common curved remote end surface, the heel wall disposed on a side of the male joint portion adjacent to a heel of the blade upon mating insertion of the male joint portion into the female joint portion, and the curved remote end surface extending between the heel and toe walls.

In a further aspect, there is provided a hockey stick blade, comprising a blade body extending between a neck and a toe, and defining a heel, the neck having a neck opening circumscribing a female joint portion disposed within the neck and adapted to receive a corresponding male joint portion of a hockey stick shaft, the blade body having opposed front and rear surfaces defining an interior blade cavity and a substantially U-shaped blade rib disposed within the blade cavity and extending from a first end disposed in the neck, to the toe, along a length of an edge of the toe, and back to a second end disposed in the neck, the first and second ends of the blade rib abutting against the male joint portion upon being received in the female joint portion.

DESCRIPTION OF THE DRAWINGS

Reference is now made to the accompanying figures in which.

DETAILED DESCRIPTION

Figure 1:
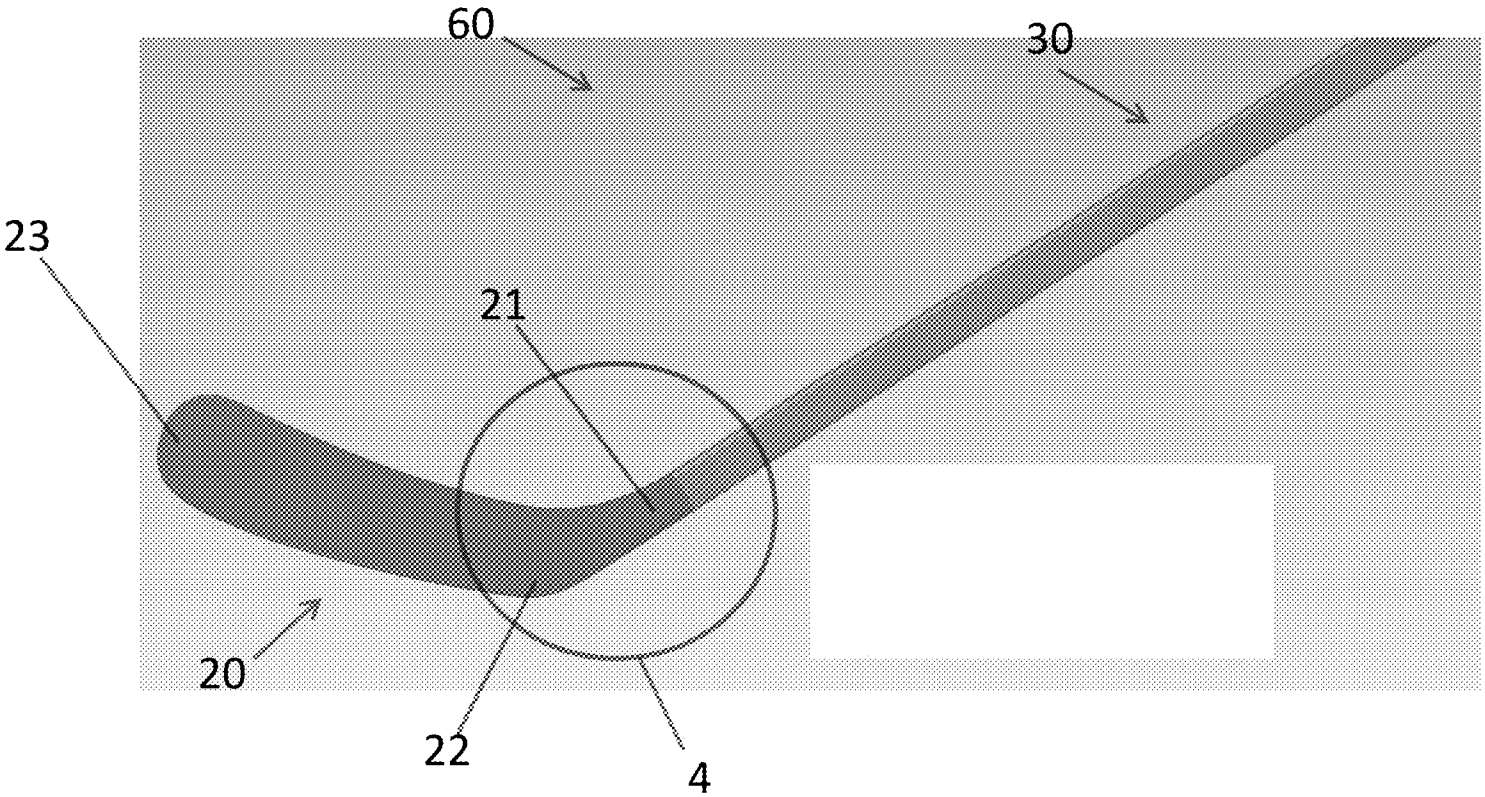
FIG. 1 is a perspective view of a hockey stick having a blade and a shaft which join together at a joint, according to an embodiment of the present disclosure.

FIG. 1 illustrates generally a hockey stick 60 (or simply "stick 60"). The stick 60 can be used to play any suitable sport or activity, and is not strictly limited to the sport of ice hockey. The stick 60 has a blade 20 which is adapted to contact an object such as a ball or puck, as well as a generally elongated shaft 30 which can be manipulated by the user of the stick 60. The blade 20 and the shaft 30 are joined together at a joint 10, and all three will now be discussed in greater detail.

The blade 20 can be any suitable curved body which provides a contact surface to be used to manipulate the object. It can be made from any suitable material, including but not limited to, solid wood, laminated wood, fiber-glass-reinforced-polymer-coated wood, fiber-reinforced polymers, aluminum, titanium, and carbon-fiber-reinforced polymers, or any combination thereof. It can also be curved along its length to provide for improved manipulation of the object. Some portion, or all, of the blade 20 can be hollow in order to reduce the overall weight of the stick 60.

The blade 20 has a blade body which is generally defined by its neck 21, its heel 22, and its toe 23. The neck 21 is the portion of the blade 20 which is in direct contact with one of the ends of the shaft 30, and which mates with this end so as to form the stick 60. It does so by defining a neck opening 40, which is any aperture or cavity within the body of the neck 21. As will be discussed in more detail below, the neck opening 40 defines and circumscribes the female joint portion which is located in the neck 21. The heel 22 is generally a curved bottom of the blade 20 which contacts the ice or playing surface when the stick 60 is in use. The toe 23, or tip, is the distal end of the blade 20 opposite the end adjacent to the shaft 30. The general shape of the blade 20 is defined between these components, in that the body of the blade 20 extends from the toe 23 to the neck 21, and defines the heel 22. It will be appreciated that the blade 20 can take shapes and configurations which differ from those shown in the figures provided that any such shape or configuration includes the above-described neck 21, heel 22, and toe 23.

Figure 2:
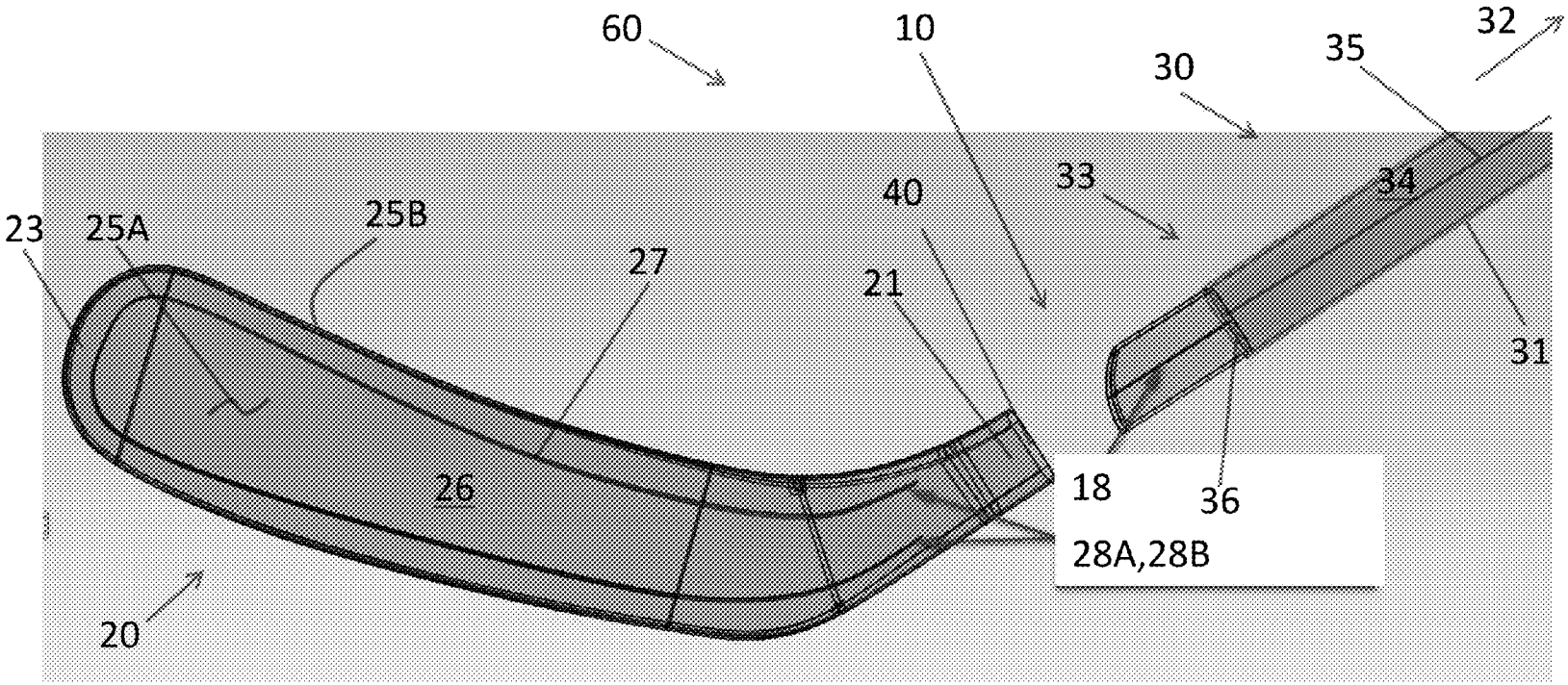
FIG. 2 is another perspective view of the hockey stick of FIG. 1, the blade and the shaft shown separated from one another and partially transparent so as to better show the interior construction thereof.

As previously mentioned, some or all of the blade 20 can be hollow. Such an embodiment of the blade 20 is shown in FIG. 2, where the blade 20 has an interior blade cavity 26 which is defined between a front surface 25A and an opposed rear surface 25B. The front surface 25A designates the area of the blade 20 which forms the primary contact surface with the object being manipulated, while the rear surface 25B is separated from the front surface 25A across the blade cavity 26. Both the front and rear surfaces 25A, 25B extend along the entirety of the blade 20 from the neck 21 to the toe 23. The curvature and shape of the surfaces 25A,25B therefore defines that of the blade 20.

The blade 20 may have one or more blade ribs 27 located within the blade cavity 26 and extending between the front and rear surfaces 25A,25B. Each blade rib 27 reinforces the stiffness of the blade 20 between the front and rear surfaces 25A,25B while helping to reduce the weight of the blade 20, and thus the overall weight of the stick 60. Each blade rib 27 therefore forms a bridge between the front and rear surfaces 25A,25B, and can be formed during the making of the blade 20 using any suitable technique. It follows that the shape of the blade rib 27 can take many forms in order to achieve the above-described functionality.

One possible shape amongst many is shown in FIG. 2. In the depicted exemplary embodiment, the blade rib 27 is a single rib which is substantially U-shaped. The U-shaped blade rib 27 begins at a first end 28A or a second end 28B, both of which are located in the neck 21 of the blade 20. From one of these ends 28A,28B, the blade rib 27 extends toward the toe 23, substantially matching the peripheral contour of the blade 20 before returning to the other end 28A,28B. For example, the blade rib 27 can extend from the first end 28A in the neck 21 along a path matching the profile of the upper edge of the blade 20 until it arrives at an edge of the toe 23. From there, the blade rib 27 curves toward the bottom edge of the blade 20, thereby forming the "U" of the blade rib 27, before curving again and extending along the bottom edge and back towards the second end 28B. It will be appreciated that such a shape of the blade rib 27 helps to reinforce the stiffness of substantially all of the blade 20, and helps to reduce the possibility of fracture due to impact. While the blade rib 27 is shown as being substantially uninterrupted, it can nonetheless be formed of a number of discrete rib sections which are spread apart and together form the discontinuous blade rib 27.

The shaft 30 joins with the blade 20, thereby forming the stick 60. The shaft 30 is manipulated by the hands of the user in order to control the blade 20 joined thereto. The shaft 30 therefore has a body 31, generally of a rectangular or oblong cross-section, which can be gripped by the user and which provides the corpus to the shaft 30. Specifically, the body 31 extends between a grip end 32 and a blade end 33. The grip end 32 corresponds to the extremity of the body 31 which is gripped by the user, and the blade end 33 corresponds to the extremity of the body 31 which is adjacent to the blade 20. The blade end 33 terminates at a distal surface 36, which forms the surface of the body 31 the further away from the grip end 32. The distal surface 36 can be any planar or non-planar surface defining one of the extremities of the shaft 30. As will be further discussed below, the blade end 33 forms the free end of the body 31 from which part of the joint 10 extends.

The body 31, and thus the shaft 30, can take any suitable shape, or have features and components, which make it suitable for the activity for which it is used. For example, it may be desirous to reduce the weight of the shaft 30, which constitutes a major component of the overall weight of the stick 60. In such an instance, the body 31 of the shaft 30 can be hollow so as to define an elongated body cavity 34. If it is desired to additionally reinforce the stiffness of shaft 30 while still providing the requisite flexibility, one or more longitudinal shaft ribs 35 can be disposed within the body cavity 34, and extend between opposed interior walls of the body 31. Each shaft rib 35 can extend along some portion, or all, of the length of the body 31 between the grip end 32 and the blade end 33. If so desired, one or more of the shaft ribs 35 can be discontinuous along their length. It will therefore be appreciated that each shaft rib 35 can reinforce the stiffness of the body 31 along its length and/or along its width, while still providing the body 31, and thus the shaft 30, with the desired amount of flexibility. In the embodiment depicted in FIG. 2, a single shaft rib 35, centrally-disposed between a toe side and a heel side of the body 31, is provided within the hollow elongated body cavity 34 of the shaft 30.

Figure 3:
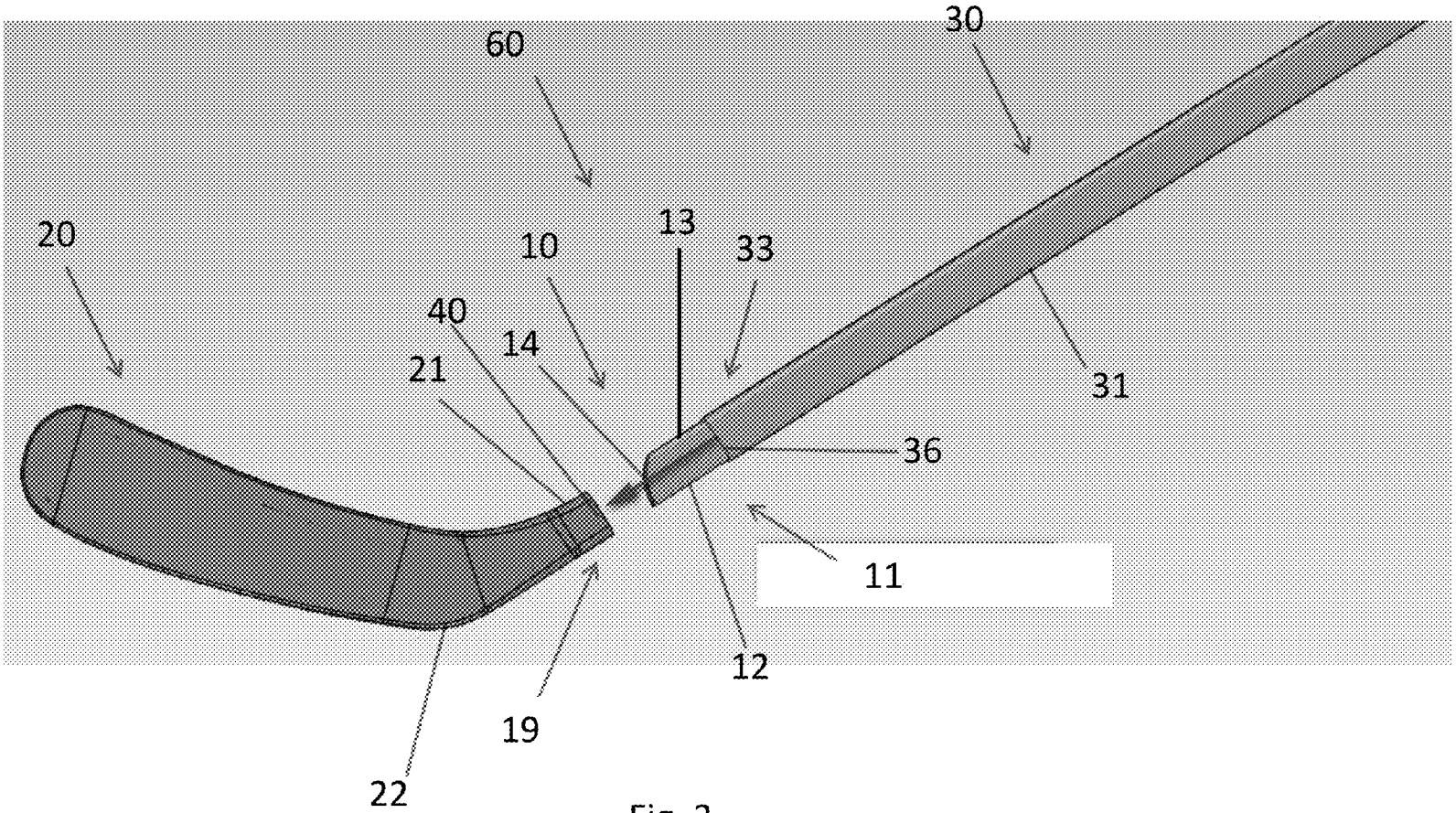
FIG. 3 is yet another perspective view of the hockey stick of FIG. 1, showing a direction along which the shaft is inserted into the blade.

Referring to FIG. 3, the joint 10 joins the blade 20 and the shaft 30 together, thereby forming the stick 60. Although it is sometimes described herein as being distinct from the blade 20 and/or shaft 30, the joint 10 and/or its features can be integral components of the blade 20, the shaft 30, or both. Indeed, the joint 10 has a female joint portion 19 (or simply "female portion 19") disposed on the blade 20, and a male joint portion 11 (or simply "male portion 11") disposed on the shaft 30, both of which will now be discussed in greater detail with reference to FIG. 3.

The female portion 19 is disposed in the blade 20, specifically in the neck opening 40 of the neck 21 of the blade 20, and is configured to receive the male portion 11 and mate therewith. As such, the neck opening 40 defines the cavity of the female portion 19 into which the male portion 11 is mated. The term "mate" or "mating" as used herein refers to the joining of the female portion 19 and the male portion 11 such that both abut against one another in order to provide a friction fit. This fit can be secured through thermal bonding, mechanical fasteners, adhesive fastening, or any other suitable technique. In order to receive the male portion 11, the female portion 19 is hollow along most or all of its length. The hollow neck opening 40 circumscribing and defining the female portion 19 is defined by internal walls 29 (see FIG. 4) of the neck 21 which define the periphery of the female portion 19.

The male portion 11 is an extension of the body 31 of the shaft 30 which protrudes from the distal surface 36 and can be inserted into, and mated with, the female portion 19. Specifically, the male portion 11 has a heel wall 12 and an opposed toe wall 13, both of which extend away from the distal surface 36 of the blade end 33 of the body 31 and terminate at a common mating surface, or remote end surface, 14. When inserted into the female portion 19, the heel and toe walls 12,13 abut against the internal walls 29 of the female portion 19. The male portion 11 thus forms the distal extremity of the end of the shaft 30 not being gripped by the user.

The heel wall 12 can be any planar or non-planar surface which extends along a first length away from the distal surface 36 of the body 31. Typically, the heel wall 12 extends along a direction parallel to the length of the body 31. The heel wall 12 is located on a side of the male portion 11 which is adjacent to the heel 22 of the blade 20. The expression "adjacent to the heel" qualifies the position of the heel wall 12 on the side of the male portion 11, in that the side (and thus the heel wall 12) abuts against the lower surface of the neck 21 near the heel 22 when the male portion 11 mates with the female portion 19. As a result, the heel wall 12 faces in whichever direction the heel 22 is oriented. For example, if the heel 22 is placed on the playing surface, the heel wall 12 will face toward the playing surface.

As with the heel wall 12, the opposed toe wall 13 can also be any planar or non-planar surface which extends along a second length away from the distal surface 36 of the body 31. Typically, the toe wall 13 will also extend along a direction parallel to the length of the body 31. The toe wall 13 is located on a side of the male portion 11 which is opposite to the side on which the heel wall 12 is disposed, and which is generally qualified as its "upper" edge. This is better explained by considering that when the stick 60 is in use, the heel wall 12 will face toward the playing surface while the toe wall 13 will face away from the playing surface. Both of the heel and toe walls 12,13 can be joined by side walls, thus forming the enclosed perimeter shape of the male portion 11.

The heel wall 12 and the toe wall 13 of the male portion 11 of the joint 10 terminate at the common remote end surface or mating surface 14. The mating surface 14 can be a curved mating surface 14 having an arcuate surface which extends between the heel wall 12 and the toe wall 13. Although sometimes referred to herein as a "curved" mating surface 14, the mating surface 14 can also be a substantially straight or planar surface. Other shapes for the mating surface 14 are also within the scope of the present disclosure. Irrespective of its shape, the mating surface 14 forms the distal extremity of the male portion 11 (and thus of the shaft 30). It also abuts against a portion of the female portion 19 when the male and female portions 11,19 are fully mated together. The degree of curvature and its orientation can vary as required. The curvature can be of a constant radius, or have a varying radius along the arc length of the curved mating surface 14. As for the orientation, the curve of the curved mating surface 14 can curve toward the blade end 33, and thus open concavely toward the blade end 33. Alternatively, the curve can curve away from the blade end 33, and thus be convex with respect to the blade end 33. Whatever its degree of curvature or orientation, the curved mating surface 14 reduces the loss in the stiffness of the stick 60 at the joint 10 when compared to conventional joints having rectangular cuboid ends extending from the blade and a planar, 90°, end mating surface.

The curved mating surface 14 extends between the distal extremities of the heel and toe walls 12,13. The length of both the heel wall 12 and the toe wall 13 are defined by the distance they each extend from the distal surface 36 of the blade end 33 of the body 31 until they reach the curved mating surface 14. The first length of the heel wall 12 is greater, and is thus longer, than the second length of the toe wall 13. Such a configuration of the heel and toe walls 12,13 provides greater stiffness to the joint 10 along its bottom, or "heel" edge where it may be most exposed to structural weakness. In so doing, this configuration of the heel and toe walls 12,13 can help to reduce the stress and strain acting on the joint 10 when the stick 60 is being used.

Figure 4:
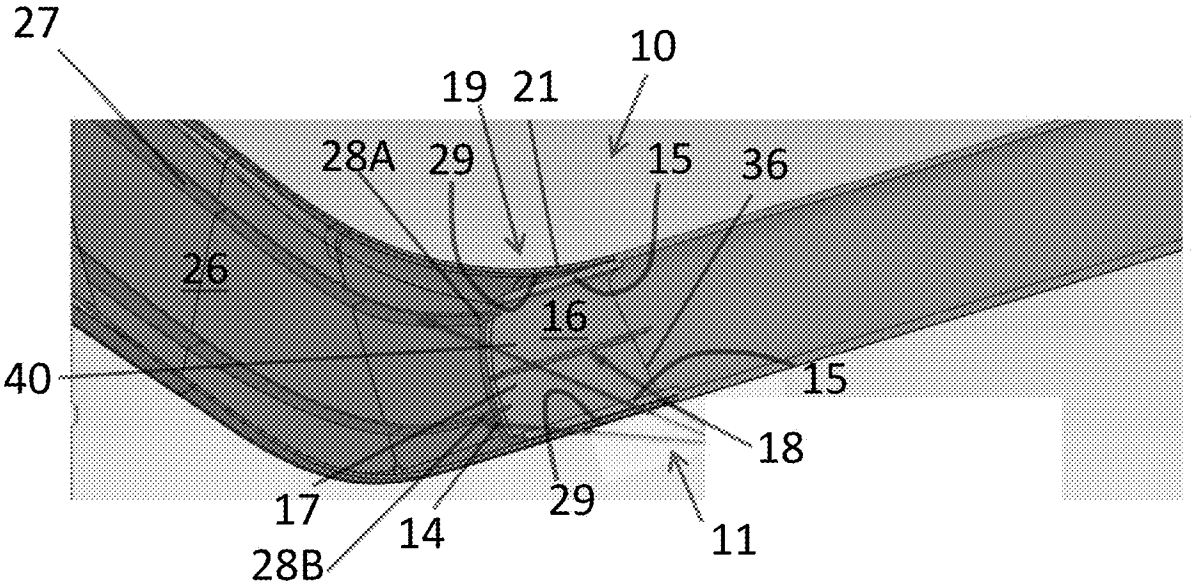
FIG. 4 is a cross-sectional view of a joint portion of the present hockey stick, taken from region 4 of FIG. 1.

In most instances, but not necessarily all, the male portion 11 is hollow. An example of such a hollow male portion 11 is shown in FIG. 4. The hollow male portion 11 contributes to reducing the overall weight of the stick 60. The hollow male portion 11 can be defined by a first pair of parallel internal surfaces 15 and a second pair of parallel internal surfaces 16. The second pair of internal surfaces 16 intersects the surfaces of the first pair 15 perpendicularly. Together, the internal surfaces 15,16 define the shape of the male portion 11 as well as its interior cavity 17, which is the volume of the hollow interior of the male portion 11.

As with some of the other components of the stick 60 discussed above, the male portion 11 can have a stiffening rib within the interior cavity 17 to reinforce the stiffness of the male portion 11, and thus of the joint 10 itself. Specifically, the male portion 11 can have one or more joint ribs 18. Each joint rib 18 can have any orientation, and can be one continuous segment, or multiple discrete segments. The direction along which the stiffness is reinforced is largely dependent on the orientation of each joint rib 18.

For example, if it is desired to reinforce the stiffness of the male portion 11 along its length between the distal surface 36 and the curved mating surface 14, the joint rib 18 can be a continuous member oriented parallel to the length of the male portion 11, and can extend along the entire length between the distal surface 36 and the curved mating surface 14. Such a joint rib 18 also forms a bridge between the second pair of internal surfaces 16. When the male portion 11 and the female portion 19 are mated together, the first and second ends 28A,28B of the blade rib 27 abut against the curved mating surface 14 on opposite sides of the joint rib 18, providing additional stiffening at different points of the joint 10. Alternatively, one or more joint ribs 18 can extend perpendicularly between the first pair of internal surfaces 15, and can also bridge the second pair of internal surfaces 16. One or more joint ribs 18 can also extend at an angle to the first pair of internal surfaces 15. These joint ribs 18 will reinforce the stiffness of the joint 10 along a different direction. It can thus be appreciated that each joint rib 18 helps reinforce the hollow male portion 11, and the joint 10 itself, along different directions while not contributing significantly to the overall weight of the stick 60.

In light of the proceeding, it can be appreciated that the joint 10 helps to securely connect the blade 20 and the shaft 30 to form the stick 60, thereby allowing the stick to be used for its intended purpose. Furthermore, the curved mating surface 14 of the male joint portion 11 helps to reduce the potential loss in total structural strength which is associated with conventional joints having rectangular cuboid shapes. In addition, the hollow nature of the female portion 19 and the male portion 11 helps to lower the overall weight of the stick 60. Such a reduction in weight, even if it is minimal in absolute terms, can significantly improve the performance of a high-end user of the stick 60, especially in a sport such as ice hockey where competitive advantages are gained from such relatively small improvements.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A two-part hockey stick comprising:

a blade extending between a neck and a toe, the blade having a heel on a bottom, playing surface facing, edge thereof;

a shaft having a body extending between a grip end and an opposed blade end; and a joint interconnecting the blade and the shaft, the joint including mating male and female joint portions, the male joint portion disposed on one of the blade end of the shaft and the neck of the blade, the female joint portion disposed on the other of the blade end of the shaft and the neck of the blade, the male joint portion having a heel wall on a first side of the male joint portion adjacent to the heel of the blade and a toe wall on a second side of the male joint portion opposite the heel wall, the heel wall being longer than the toe wall.

2. The two-part hockey stick according to claim 1, wherein the male joint portion is disposed on the shaft and the female joint portion is disposed on the blade.

3. The two-part hockey stick according to claim 1, wherein the heel wall and the toe wall of the male joint portion terminate at a common mating surface extending between the heel and toe walls, and wherein the common mating surface is curved and protrudes convexly away from the blade end of the body of the shaft.

4. The hockey stick according to claim 3, wherein the mating surface of the male joint portion defines a curved abutting surface which abuts one or more surfaces within the female joint portion.

5. The two-part hockey stick according to claim 1, wherein the male joint portion has an interior cavity defined therein between internal surfaces of the heel wall and the toe wall, and one or more reinforcement ribs being disposed within the interior cavity.

6. The two-part hockey stick according to claim 5, wherein the one or more reinforcement ribs are substantially parallel to the heel wall and the toe wall.

7. The two-part hockey stick according to claim 5, wherein the one or more reinforcement ribs are equally spaced apart between the heel wall and the toe wall.

8. The two-part hockey stick according to claim 1, wherein the blade has a front surface and an opposed rear surface, each of the front and rear surfaces extending from the neck to the toe and defining an interior blade cavity, and at least one blade rib disposed within the blade cavity and extending between the front and rear surfaces.

9. The two-part hockey stick according to claim 8, wherein the at least one blade rib is substantially U-shaped and extends from a first end disposed in the neck, to the toe, along a length of an edge of the toe, and back to a second end disposed in the neck.

10. The two-part hockey stick according to claim 9, wherein the first and second ends of the at least one blade rib abut against the mating surface.

11. The two-part hockey stick according to claim 1, wherein the male joint portion has at least one joint rib extending therethrough, the joint rib being disposed between the heel wall and the toe wall.

12. The two-part hockey stick according to claim 1, wherein the body of the shaft is hollow and has a body cavity.

13. The two-part hockey stick according to claim 12, wherein the body of the shaft has at least one longitudinal shaft rib disposed within the body cavity and extending parallel to a length of the body between the grip end and the blade end.

14. A hockey stick shaft, comprising a body extending between a grip end and an opposed blade end, and a male joint portion disposed at the blade end of the shaft and adapted to mate with a corresponding female joint portion of a hockey stick blade, the male joint portion having a heel wall on a first side of the male joint portion and a toe wall on a second side of the male joint portion opposite the heel wall, the heel wall being adapted to be located adjacent to a heel of the hockey stick blade upon mating insertion of the male joint portion into a cooperating female joint portion on the hockey stick blade, the heel wall of the male joint portion being longer than the toe wall such that the heel wall of the male joint portion extends further than the opposed toe wall.

15. The hockey stick shaft according to claim 14, wherein the heel wall and the toe wall of the male joint portion terminate at a remote end surface extending therebetween, the remote end surface is curved and protrudes convexly away from the blade end of the body of the shaft.

16. The hockey stick shaft according to claim 14, wherein the male joint portion has an interior cavity defined between internal surfaces of the heel wall and the toe wall, and one or more reinforcement ribs being disposed within the interior cavity.

17. The hockey stick shaft according to claim 16, wherein the one or more reinforcement ribs are substantially parallel to the heel wall and the toe wall.

18. The hockey stick shaft according to claim 17, wherein the one or more reinforcement ribs are equally spaced apart between the heel wall and the toe wall.

19. The hockey stick shaft according to claim 14, wherein the remote end surface defines a curved abutting surface adapted to abut one or more surfaces within the hockey stick blade.

20. A hockey stick blade comprising a blade body extending between a neck and a toe, the blade having a heel on a bottom, playing surface facing, edge thereof, the neck having a neck opening circumscribing a female joint portion disposed within the neck and adapted to receive a corresponding male joint portion of a hockey stick shaft, the blade body having opposed front and rear surfaces defining an interior blade cavity and a blade rib disposed within the blade cavity and having a substantially U-shape, the blade rib having first and second ends disposed in the neck and adapted to abut against the male joint portion upon being received in the female joint portion, the first end being on the heel-side of the blade and the second end being on the opposite toe-side of the blade, the second end of the blade rib being closer to the neck opening than the first end of the blade rib.

* * * * *